US008864252B1

(12) United States Patent
Rodriguez Cobas et al.

(10) Patent No.: US 8,864,252 B1
(45) Date of Patent: Oct. 21, 2014

(54) TILT OUT AND REMOVABLE DOOR STORAGE

(75) Inventors: Isabel Rodriguez Cobas, Nuevo Leon (MX); Joel Barron Ramirez, Nuevo Leon (MX)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/588,167

(22) Filed: Aug. 17, 2012

(51) Int. Cl.
*A47B 96/04* (2006.01)

(52) U.S. Cl.
USPC ..... 312/405.1; 312/321.5

(58) Field of Classification Search
CPC ..... A47B 88/06; A47B 46/00; A47B 46/005; F25F 25/025; F25F 23/04
USPC ..... 312/270.1, 270.2, 321.5, 327–328, 404, 312/405.1; 211/150
See application file for complete search history.

(56) References Cited

U.S. PATENT DOCUMENTS

| | | | | |
|---|---|---|---|---|
| 2,694,906 | A | 11/1954 | Didion | |
| 2,730,423 | A * | 1/1956 | Mock | 312/334.22 |
| 2,898,173 | A | 8/1959 | Squire | |
| 4,186,978 | A | 2/1980 | Thomson | |
| 4,333,588 | A | 6/1982 | Schreck | |
| 4,859,010 | A | 8/1989 | Jeziorowski | |
| 5,193,892 | A | 3/1993 | Swindell | |
| 6,742,855 | B2 | 6/2004 | Whitaker | |
| 6,908,163 | B1 | 6/2005 | Hebeler | |
| 7,070,249 | B2 | 7/2006 | Leimkuehler | |
| 7,469,553 | B2 * | 12/2008 | Wu et al. | 62/344 |
| 7,472,974 | B2 * | 1/2009 | Czach et al. | 312/405.1 |
| 7,775,613 | B2 * | 8/2010 | Williams | 312/321.5 |
| 2002/0117947 | A1 * | 8/2002 | Cheng | 312/327 |
| 2003/0020386 | A1 | 1/2003 | Leimkuehler | |
| 2003/0102787 | A1 | 6/2003 | Whitaker | |
| 2010/0140284 | A1 | 6/2010 | Kim | |

FOREIGN PATENT DOCUMENTS

| | | | |
|---|---|---|---|
| GB | 2176884 | A | 1/1987 |
| WO | 2002014761 | A1 | 2/2002 |

* cited by examiner

*Primary Examiner* — Matthew Ing

(57) ABSTRACT

A refrigerator is provided that includes a storage assembly including a removable storage bin. The bin of the storage assembly may be rotatable to be tilted relative to a housing in the refrigerator to move the bin between and open and closed position. While in an open position, the bin may also be removed by lifting the bin away from the housing to easily remove the storage bin from the refrigerator. Furthermore, the storage assembly includes little to no moving parts. The ease of use of the tilting and removing of bin of the storage assembly provides quick access and usability of the storage bin.

18 Claims, 11 Drawing Sheets

TILT OUT AND REMOVABLE DOOR STORAGE

FIELD OF THE INVENTION

The invention relates generally to the field of refrigerators. More particularly, but not exclusively, the invention relates to a storage bin assembly for a refrigerator that includes a storage bin that can be easily tilted and removed from a housing in the refrigerator and that includes few components.

BACKGROUND OF THE INVENTION

Bottom mount refrigerators include a freezer compartment on the bottom, with the fresh food or refrigerator compartment above the freezer compartment. One or more doors provide access to the fresh food compartment, and a separate door provides access to the freezer compartment. The freezer door or doors may be drawer-type doors that are pulled out, or they may be hingedly connected similar to the refrigerator compartment doors, such that they are rotated to provide access within.

Both the refrigerator doors and the freezer doors may include shelves, bins, and other storage compartments positioned on the inside of the doors. The storage compartments are sized and positioned to provide additional storage to maximize the amount of usable space within the refrigerator and freezer compartments. Some of the door mounted storage compartments may also be removable. The removability of the compartments allows for the compartments to be more easily cleaned, while also providing a chilled, stand-alone unit for storing and accessing perishable food items outside of the refrigerator.

Current refrigerators include bins that can be tilt out and removed from the door or within the cabinet of the refrigerator. However, many of the tilt out and/or removable bins are hard to be removed or even impossible. In addition, many include complex and expensive mechanisms. For example, some tilt out and/or removable storage bins include a button that is pushed to mechanically release the bin from a housing. The disadvantage to this type of storage compartment is that the components are complex and expensive. The assemblies must include multiple moving parts that lock the storage compartment in place, while also providing for a button to release the compartment to be able to tilt out or remove the compartment from the refrigerator.

Therefore, there is a need in the art for a refrigerator having an improved tilt out and/or removable storage compartment assembly that is easy to use, easy to install, and less expensive than current versions.

SUMMARY OF THE INVENTION

Therefore, it is a primary object, feature, and/or advantage of the present invention to provide an apparatus that overcomes the deficiencies in the art.

It is another object, feature, and/or advantage of the present invention to provide a simple tilt out and removable storage compartment.

It is yet another object, feature, and/or advantage of the present invention to provide a refrigerator with a removable storage assembly positioned on a door.

It is still another object, feature, and/or advantage of the present invention to provide a removable storage compartment that can be locked in a closed position.

It is another object, feature, and/or advantage of the present invention to provide a storage assembly that includes few moving parts for removing from within a refrigerator.

It is still another object, feature, and/or advantage of the present invention to provide a storage assembly that includes a built-in track, pivots, and locks that allow a bin to be opened and locked closed with no additional components or mechanisms.

It is yet a further object, feature, and/or advantage of the present invention to provide an easily removable and cleanable storage assembly for a refrigerator.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present invention, a refrigerator is provided. The refrigerator includes a cabinet, and at least one door for providing access to within the cabinet. A storage assembly is positioned within the cabinet and comprises a housing and a removable bin. The bin comprises a storage area and a first guide track on the outside of the storage area configured to define movement of the bin. The housing comprises a guide point configured to direct the movement of the bin about the guide track and a pivot point.

According to another aspect of the present invention, a storage assembly is provided. The storage assembly includes a housing comprising a guide point and a removable bin comprising a storage area and a track positioned on the outside of a wall of the storage area. The guide point is configured to reside within the track and the bin is configured to move relative to the guide point along the track to tilt the bin and selectively remove the bin from the housing.

According to yet another aspect of the present invention, a method of tilting and removing a storage bin from a housing is provided. The method includes providing a storage bin assembly comprising a housing having a guide point and a pivot point, and a bin having a storage area and a track positioned on the outside of a wall of the storage area. The bin is tilted by pulling the top of the bin to move a first section of the track relative to the guide point to an open position. The bin can be removed at the open position by moving a second section of the track relative to the guide point in a generally upward manner.

DETAILED DESCRIPTION OF THE PREFERRED EMBODIMENTS

Figure 1:
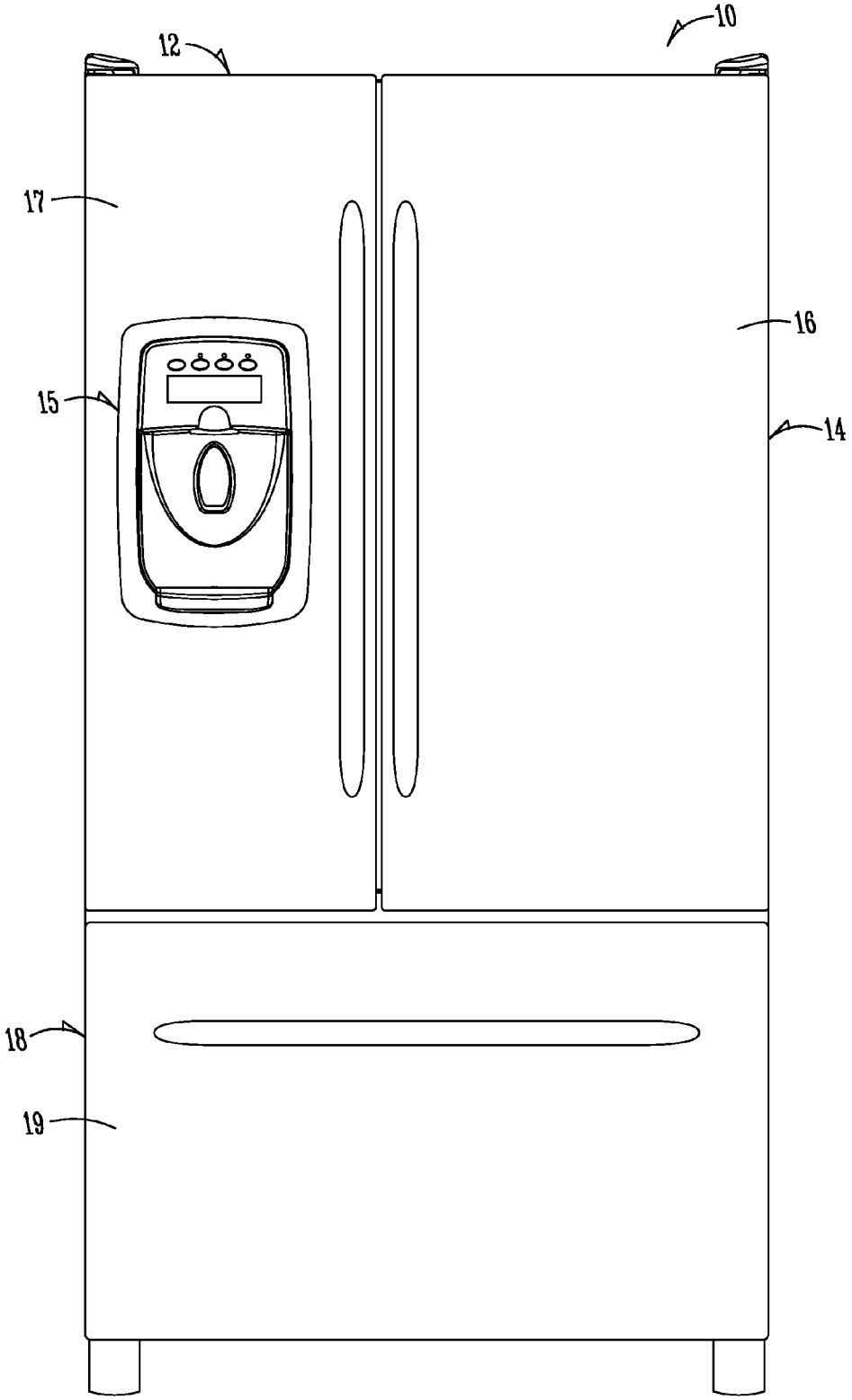
FIG. 1 is a front elevation view of a bottom mount refrigerator.

FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 14. A dispenser 15 is positioned on one of the doors 16, 17 of the refrigerator compartment 14. The dispenser 15 may be a water dispenser, ice dispenser, other beverage dispenser, or some combination thereof. Furthermore, the dispenser 15 may be placed on any door of the refrigerator 10, or the dispenser 15 may be placed within one of the compartments of the refrigerator 10. For example, the dispenser 15 may be placed at one of the interior walls of the refrigerator compartment 14, thus being part of the cabinet 12. The placement of the dispenser 15 is not to limit the present invention. Positioned generally below the refrigerator compartment 14 is a freezer compartment 18. A freezer door 19 provides access to within the freezer compartment 18. The freezer door 19 of FIG. 1 is shown as a drawer-type door. However, the present invention contemplates that the freezer door 19 may be a drawer, a hinged door, multiple doors, or some combination thereof.

It should also be appreciated that, while the figures show a bottom mount-style refrigerator 10, the present invention contemplates that any style of a refrigerator be included as part of the invention. The figures merely depict one example of a type of refrigerator that can be used with the present invention.

Figure 2:
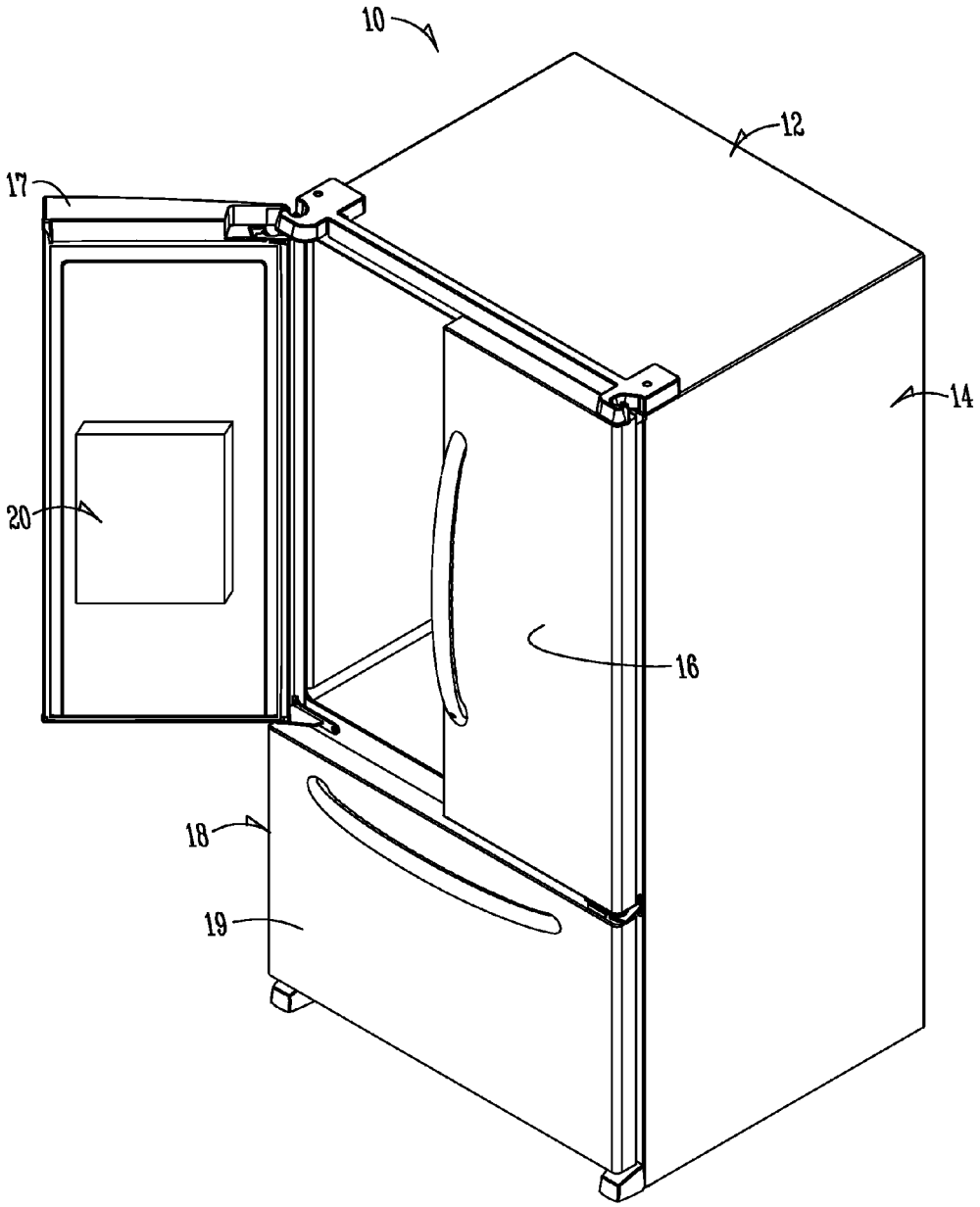
FIG. 2 is a perspective view of the refrigerator of FIG. 1 with a door open to show the interior of the refrigerator.

FIG. 2 is a perspective view of the refrigerator 10 of FIG. 1 having a refrigerator door 17 opened to show an interior of the refrigerator 10 and door 17. The figure shows a storage assembly 20 positioned on the interior of the door 17. The storage assembly 20 of the present invention is a removable-style storage compartment, such as a removable storage bin. The storage bin is used to provide extra storage space on the door 17. However, as the storage bin is removable from the door 17, it will have many advantages over prior storage areas. For example, the removability of the storage bin of the storage assembly 20 allows for easier cleaning of the storage container. Furthermore, the removability allows a user to remove the chilled storage container with perishable items stored therein to take to a remote location. As the storage container will remain chilled for a period of time, the perishable items will not spoil easily or quickly.

While the storage assembly 20 is shown to be positioned on the interior of the door 17, it should be appreciated that the location of the storage assembly 20 is not to be limiting to the present invention. For example, the storage assembly 20 may be positioned anywhere within the cabinet 12 of the refrigerator 10, including the inside of the other door 16 or anywhere within the refrigerator compartment 14. Furthermore, the storage assembly 20 could be used within the freezer compartment 18 as well. As the storage assembly 20 of the present invention provides an efficient removable assembly that is easy to use, easy to install, and less expensive than previous storage containers, it should be appreciated that the storage assembly 20 could be placed anywhere within the refrigerator 10.

Figure 3:
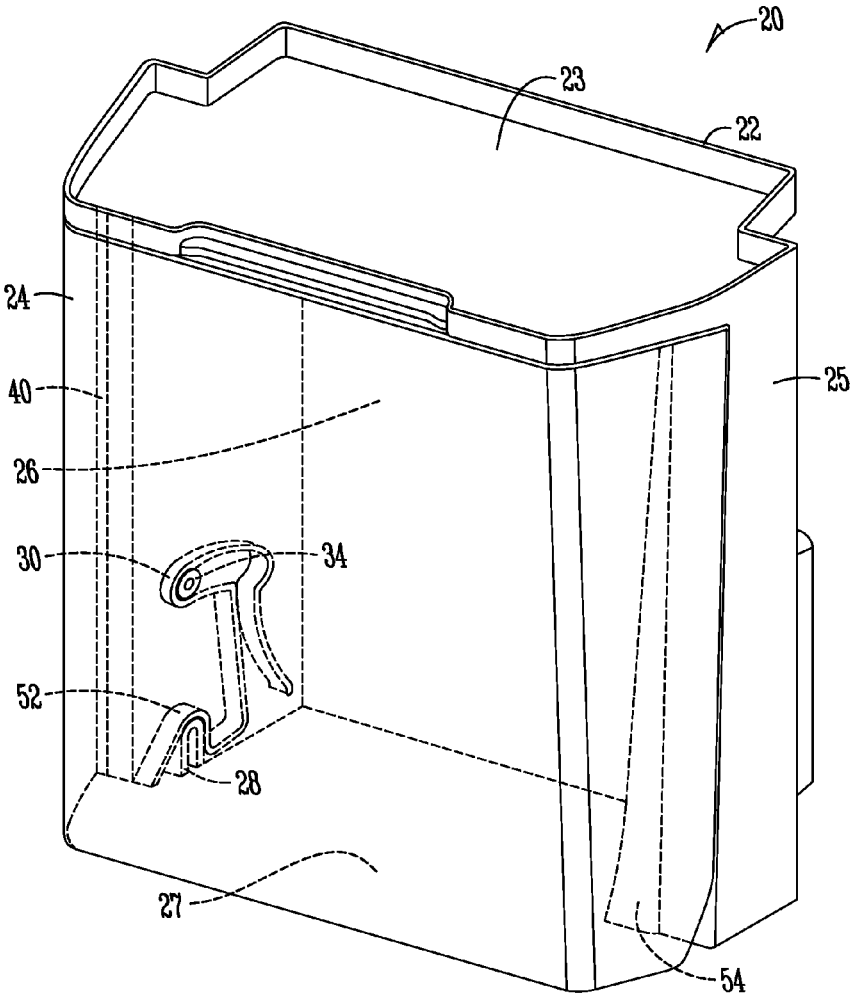
FIG. 3 is a perspective view of the storage assembly of the present invention in a closed position.
Figure 4:
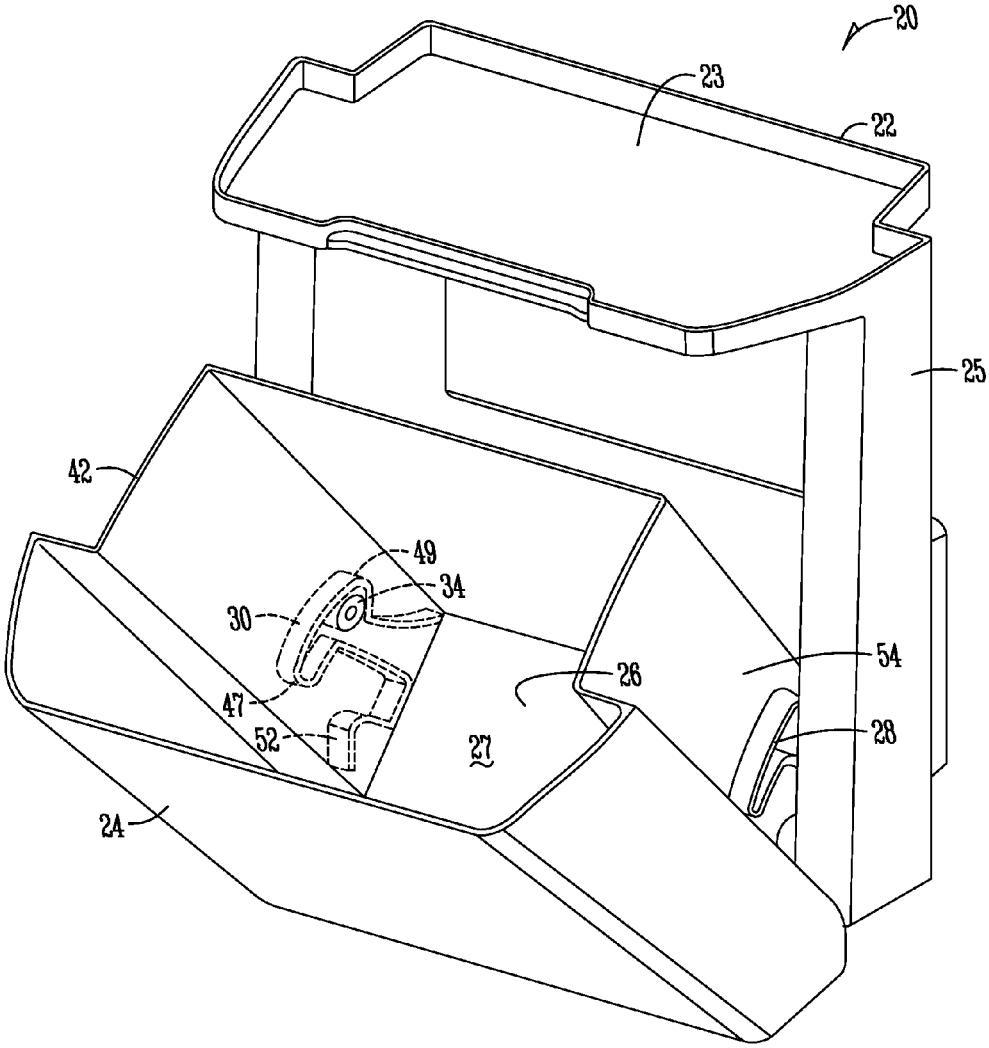
FIG. 4 is a perspective view of the storage assembly of the present invention in an open position.

FIGS. 3 and 4 are perspective views of the storage assembly 20 of the present invention with the bin 24 in a closed position 40 as shown in FIG. 3, and with the bin 24 in an open position 42 as shown in FIG. 4. The storage assembly 20 comprises generally a housing 22 and a bin 24. The housing 22 is positioned in the refrigerator 10 and will generally not be removed from the refrigerator 10. The bin 24 is moveable in relation to the housing 22. The housing 22 includes a housing body 25 with a top 23. The housing body 25 is configured to attach to an interior surface of the refrigerator 10 or refrigerator door. Furthermore, the housing 22 may comprise any rigid material, such as plastic or the like. Furthermore, as will be appreciated, the housing 22 may also be formed as part of the liner of a refrigerator compartment 14, freezer compartment 18, or one of the doors 16, 17, 19, of the refrigerator 10. The housing 22 may be formed integrally with the lining of the refrigerator 10 such that the bin 24 may be easily inserted and removed from the refrigerator 10. Furthermore, if the housing 22 is formed integrally with the liner of the refrigerator 10, the size of the housing 22 and bins 24 may be configured such that different sized bins may be used with the same housing locations and change according to the preference of the user of the refrigerator 10.

Extending inwardly from the housing body 25 are first and second guide points 32, 34. The guide points 32, 34 are rollers or bearing-type members that will ride or be housed within first and second guide tracks 28, 30 of the bin 24. The guide points 32, 34 should be configured such that the points will aid in movement of the bin 24 relative to the housing 22. Thus, the guide points 32, 34 may be any such material and configuration to aid in the movement of said bin 24.

The bin 24 includes a storage area 26 having a bottom 27 and a plurality of walls 54 extending upwardly from the bottom 27. Therefore, the bin 24 may include generally any shape as preferred for different styles of refrigerators 10. The bin 24 may be configured such that it coincides with the housing body 25 such that the bin 24 will fit and reside within the housing body 25 in the closed position as is shown in FIG. 3. However, it should be appreciated that the shape of the bin 24 may not be limited by that shown in the figures, and that the invention contemplates generally any shape of bin 24. Furthermore, the bin 24 may comprise a material, such as plastic or the like, that is safe to use with food and other perishables. For example, the material in the bin 24 may be a food grade plastic. Furthermore, while FIG. 3 shows that the bin 24 comprises a generally clear material, it is contemplated that the opaqueness of the material may also be varied. However, the clearness of the bin material will provide a window to view the contents of the storage area 26 of the bin 24 without having to open the bin 24, which also aids in keeping cooled air within the storage bin 24.

FIGS. 5A-5E show a close up of one side of the storage assembly 20 in varied steps between an open and closed position. Furthermore, while the figures show only one side of the storage assembly 20, it should be appreciated that the opposite side is generally a mirror image of the side shown, and thus a description of the side shown in FIGS. 5A-5E will also sufficiently describe the opposite side thereof.

Figure 5A:
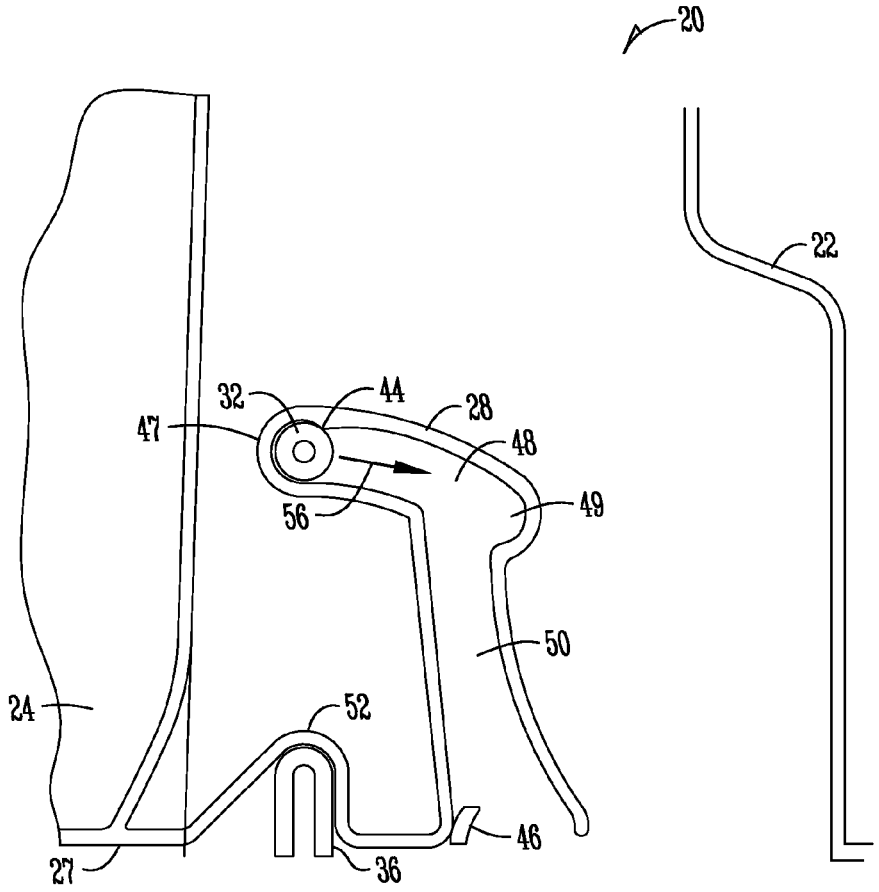
FIGS. 5A-5E are sectional views of the storage assembly in various steps between an open and closed position.

FIG. 5A shows a close up of the side of the storage assembly 20 with the bin 24 in a closed position. The figure shows a configuration of the first guide track 28, which is formed of a protrusion extending outwardly from a wall 54 of the storage bin 24. As noted above, the first guide point 32 is configured to extend within the first guide track 28 and to move within the guide track 28 to aid in the tilting and removal of the bin 24 from the housing 22. When the storage assembly 20 is in the closed position as is shown in FIG. 5A, the bin 24 will be held in place in said closed position by the combination of a guide track lock 44 and a housing lock 46. The guide track lock 44 is a protrusion in the guide track 28 to hold the guide point 32 in place near the front 47 of an arched section 48 of the guide track 28. Thus, force must be applied to the bin 24 to overcome the mechanical interference of the lock 44 and to move the guide point 32 relative to the guide track 28. Such movement would be in the direction shown by the arrow 56 in FIG. 5A. The housing lock 46 is a secondary lock near the bottom of the housing 22 that is used only to improve the closed position, i.e., keeps it completely closed. The housing lock 46 can be added to avoid adding more mechanical interference between the guide track lock 44 and the guide point 32. Increasing the amount of protrusion of the guide track lock 44 would require regular amount of force to being opening or tilting of the bin 24.

Also shown in FIG. 5A is a first pivot point 36 and corresponding bin notch 52. The pivot point 36 is a protrusion extending inwardly from the housing body 25 of the housing 22. The notch 52 comprises an extrusion or protrusion from the wall 54 of the bin 24. Furthermore, as shown in the figure, the notch 52 may comprise an extension of the guide track 28. The pivot 36 is the point where the bin 24 sits and over which it tilts. Thus, the pivot 36 supports the bin 24 in a normal configuration. A preferred location for the pivot point 36 is anywhere in front of the center of gravity of the bin 24, such that it is easier to keep it closed. However, when the bin is moved such that the guide point 32 moves in the direction of the arrow 56 in FIG. 5A, the rotation of the bin 24 will be about the pivot point 36. Thus, the configuration of the notch 52 is such that it will allow rotation about the pivot point 36.

Figure 5B:
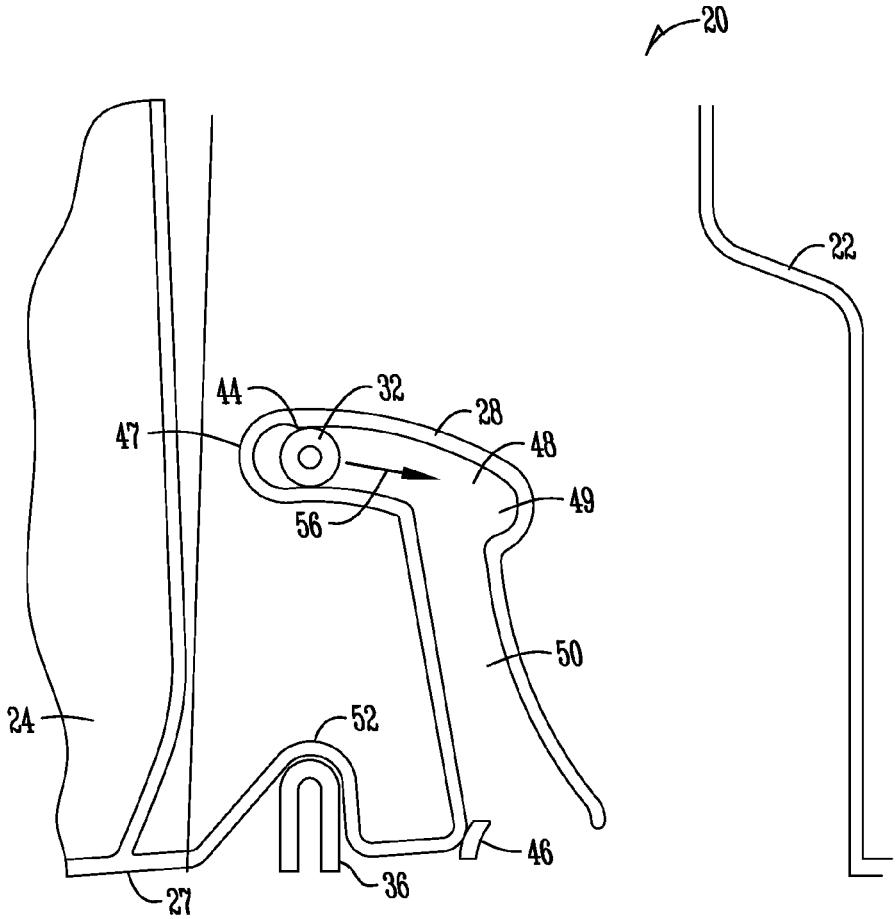

FIG. 5B shows a position of the first guide point 32 relative to the guide track 28 after the bin 24 has begun to be tilted towards an open position. The Figure shows the tilting of the bin 24 after a force has been applied to overcome the guide track lock 44 in the guide track 28. At this point, the bin 24 has begun to rotate at the notch 52 relative to the pivot point 36, and is also overcoming the housing lock 46. Therefore, an additional force is needed to be applied to overcome the housing lock 46.

Figure 5C:
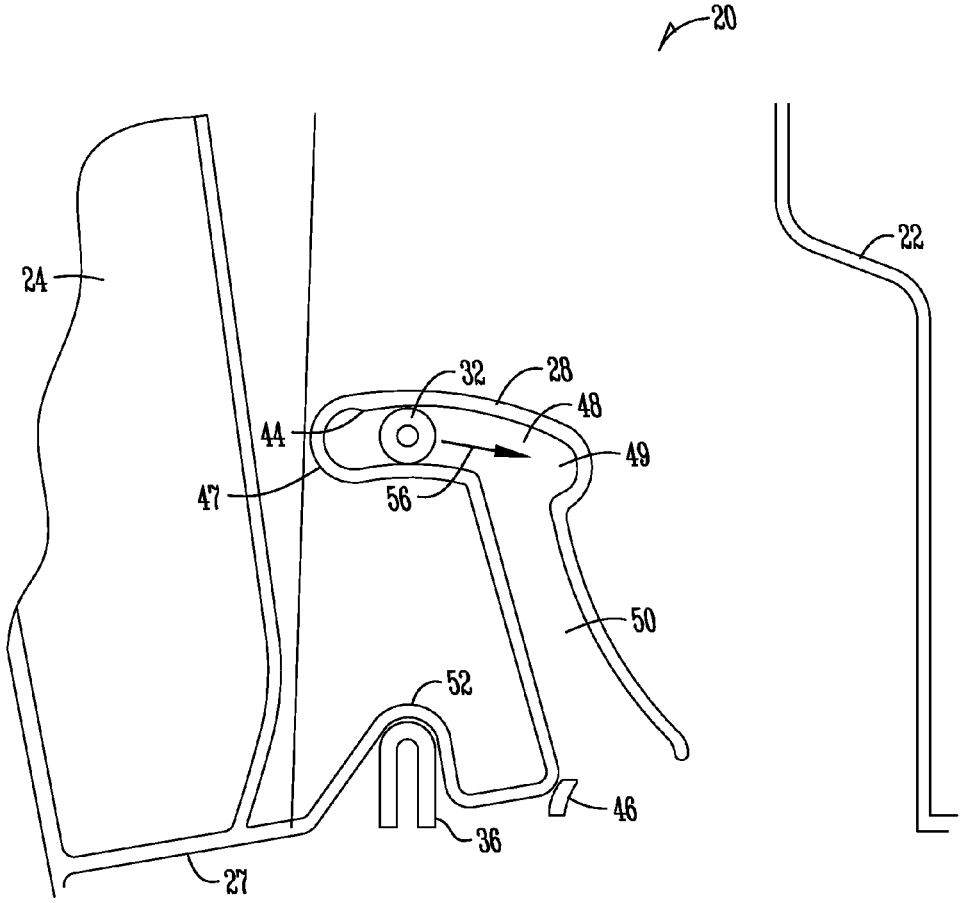

FIG. 5C shows the bin 24 continuing to be tilted towards an open condition or position. At this point, the guide point 32 has moved beyond the guide track lock 44 of the first track 28 along an arched section 48 of the guide track, and can continue to move in the direction shown by the arrow 56 towards the back or rear 49 of the arch section 48. At this point, the bin 24 is also beginning to become free of the housing lock 46, which will allow for easier rotation or tilting of the bin 24.

Figure 5D:
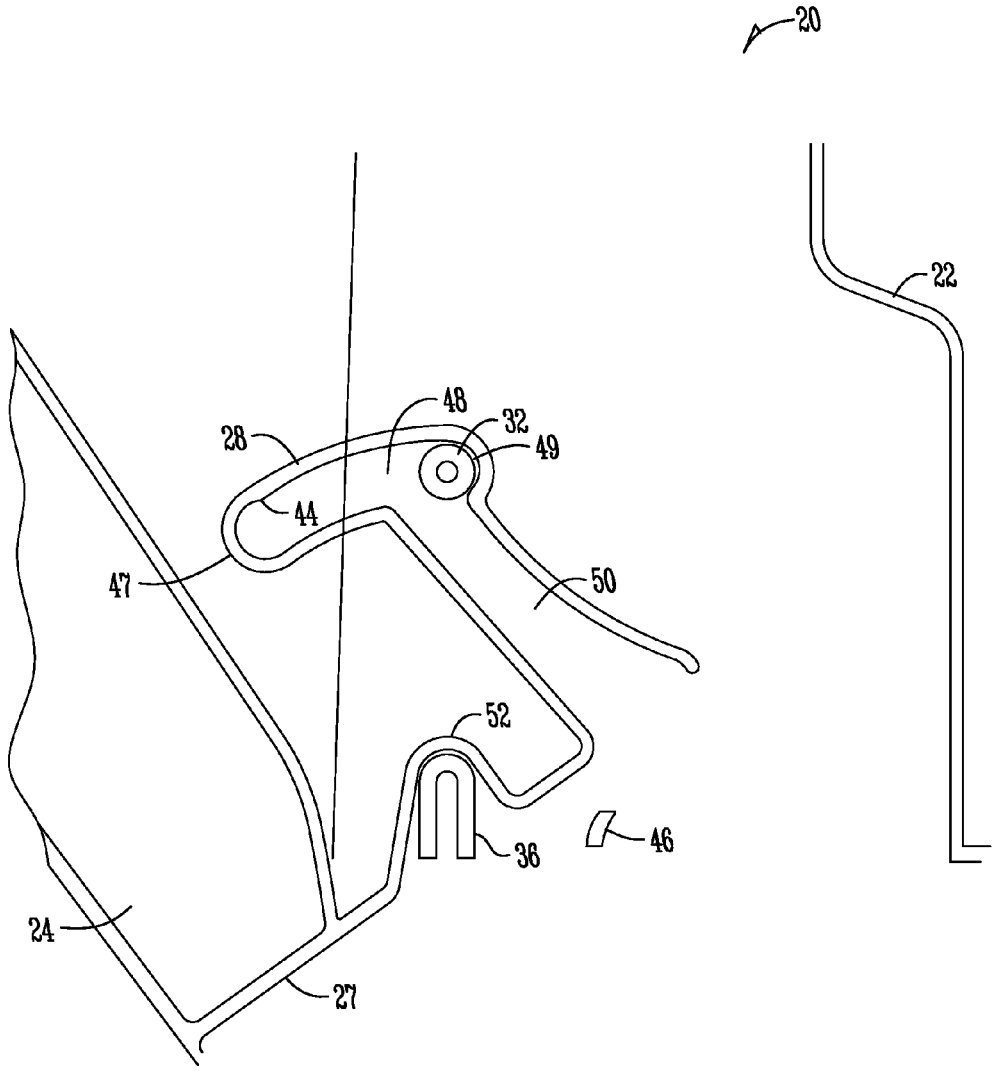

FIG. 5D shows the bin 24 in a fully opened position. The bin 24 has been rotated about the pivot point 36 such that the guide point 32 has traveled along the first guide track 28 to the back end 49 of the guide track 28. The back end 49 of the arched section 48 of the first guide track 28 is configured such that it will prevent any further rotation or tilting of the bin 24 relative to the housing 22. At this point, the consumer will have full access to reach within the storage area 26 of the bin 24. Furthermore, it should be noted that the bin 24 is not under the influence of any locks at this position besides the rear end 49 blocking further rotation of the bin 24.

Figure 5E:
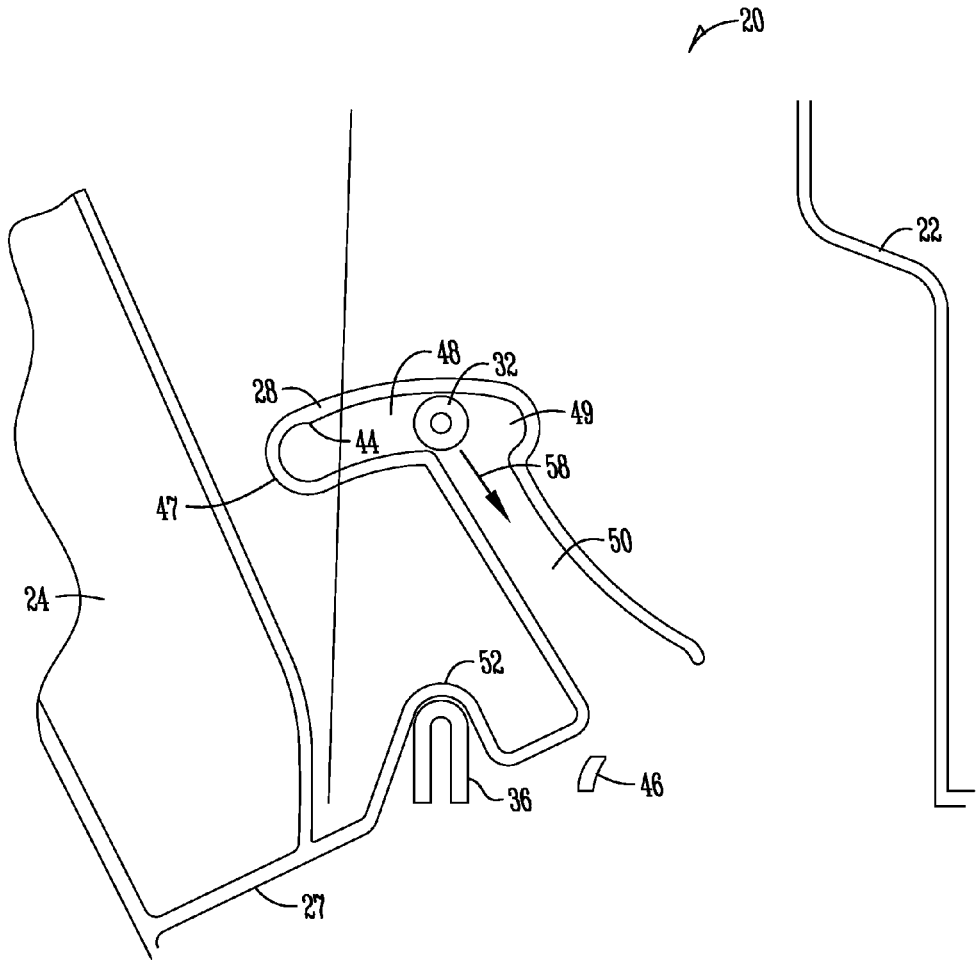

FIG. 5E shows the bin 24 positioned relative to the housing 22 such that the bin can be removed from the housing 22. Note that the first and second guide tracks 28, 30 include an arched section 48 and a relatively vertical section 50 when in the fully closed position as shown in FIG. 5A. The arched section 48 is configured to provide the tilting or rotational movement of the bin 24 relative to the housing 22. However, the vertical section 50 is configured to provide the removability of the bin 24 relative to the housing 22. As shown in FIG. 5E, the guide point 32 is aligned generally within the opening of the vertical section 50. While the rear or back end 49 of the guide track 28 may have a lip to prevent straight access, the bin 24 may have to be rotated back towards the housing 22 a portion from the fully opened position. At this point, the bin 24 can be raised or pulled out from the housing 22, which moves the guide point 32 in the direction of the arrow 58 as shown in FIG. 5E. Once the bin 24 has begun to be removed, the shape and configuration of the vertical section 50 of the guide track 28 will aid the direction of removal for the consumer. Therefore, the consumer will not have to worry about ensuring that the guide point 32 is aligned with the guide track 28 the full way. The configuration and shape of the vertical section 50 of the guide track 28 will automatically align with the guide point 32 to aid in the removal. Furthermore, it should be appreciated that the back end 49 of the arched section 48 of the guide track may segue directly into the opening of the vertical section 50. In this configuration, a consumer would know that the bin 24 can be removed once the guide track 32 has come into contact with the back end 49, and would not have to worry about aligning the guide point 32 with the vertical section 50.

Therefore, to operate the tilt and removability of the storage assembly 20 from a fully closed position is as follows. A top portion of the bin 24 can be pulled outwardly, which would be in a counterclockwise manner as shown in FIGS. 5A-5E. Force must be provided to overcome the mechanical interference of the guide track lock 44 and housing lock 46. Once the force has overcome the initial locks, the guide point 32 will move along the arch section 48 of the guide track 28, and the notch 52 of the bin 24 will rotate about the pivot point 36 of the housing 22. Continued outward force of the bin 24 will move the guide track 28 relative to the guide point 32 in the direction shown by the arrow 56. Continued force can be applied until the guide point 32 resides at the rear end 49 of the arch section 48 of the guide track 28. At this point, the consumer will have full access to the contents within the bin 24.

If the bin 24 is to be removed from the housing 22, the guide point 32 can be aligned with the opening of the vertical section 50 of the guide track 28. A generally upward force of the bin 24 will cause the guide point 32 to be moved in the direction of the arrow 58 in FIG. 5E along the vertical section 50 of the guide track 28. The configuration of the vertical section 50 will guide the guide point 32 along the track 28 such that the consumer will merely lift in the same direction.

In order to replace the bin 24 within the refrigerator 10 and housing 22, the opposite steps are required. For example, the bottom end of the vertical section 50 is aligned with the first and second guide points 32, 34. A downward force is applied to move the guide point 32 along the vertical section 50 of the guide track 28 until the guide point 32 reaches the arched section 48 of the guide track 28. At this point, the bin 24 can be rotated to move the guide track 28 relative the guide point 32. The movement will be clockwise direction as shown in the figures. The movement of the bin 24 continues until the guide point 32 overcomes the mechanical interference of the guide track lock 44 and resides at the front end 47 of the arched section 48. At this point, the guide track lock 44 and housing lock 46 will hold or lock the bin 24 in a closed position relative to the housing 22.

Figure 6:
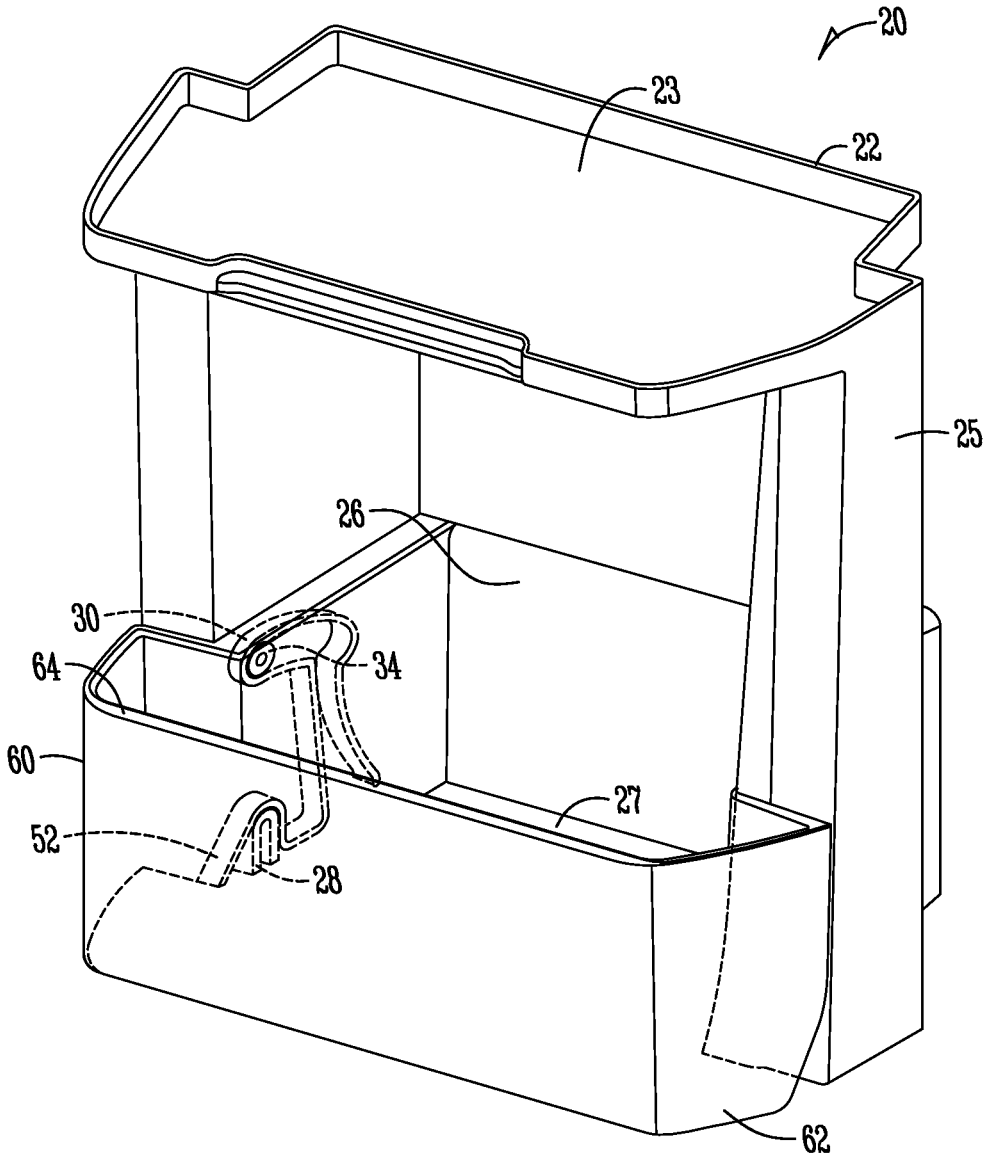
FIG. 6 is a perspective view of another embodiment of a tiltable and removable bin according to the present invention.
Figure 7:
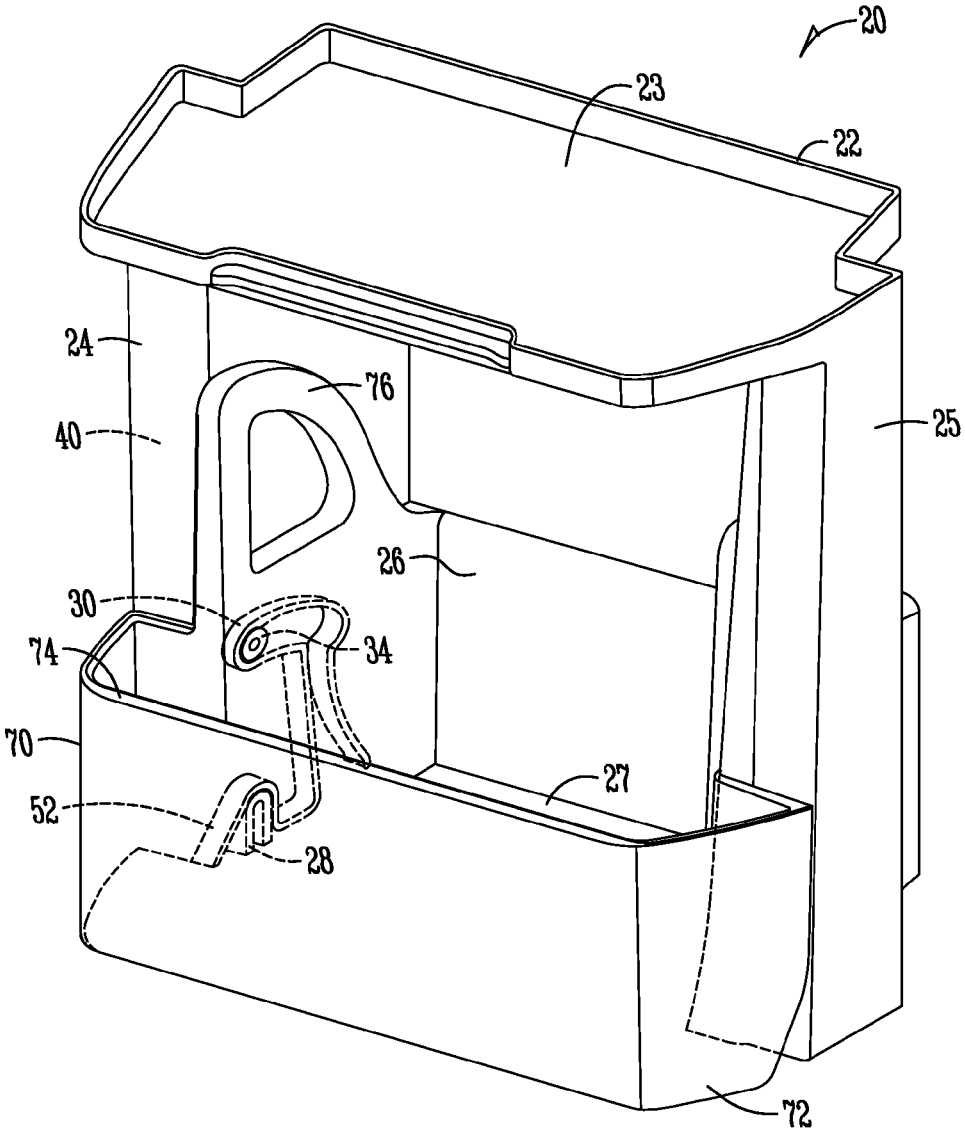
FIG. 7 is a perspective view of another embodiment of a tiltable and removable bin according to the present invention.

FIGS. 6 and 7 are additional embodiments of tiltable and removable bins 60, 70. It should be noted that the bins 60, 70 shown in FIGS. 6 and 7 are housed in the same housing 22 as the bin 24 shown in FIGS. 3-5E. Thus, the housing 24 will include the same walls and guide points 32, 34 as before. This allows the bins to be transferable both within a refrigerator 10 having multiple housings and between multiple refrigerators each having the housing.

The bin 60 shown in FIG. 6 is similar to the bin 24 described above, except that includes shorter walls 62 extending upward from the floor or bottom 27 of the bin 60. The shorter walls 62 allow for easier access when the bin 60 is positioned in a closed position within the housing 22. The shorter walls 62 also provide a smaller bin with a smaller storage area that may be more convenient to use outside of the refrigerator 10. The shorter walls also allow items stored within the bin 60 to be removed without tilting the bin as well.

It should be noted that the first and second guide tracks 28, 30 are the same size and configuration as that shown in the figures above. This is to enable the bin 60 to be used with the same housing 22 as before. In addition, the tilting and removable of the bin 60 will also be the same as that described above. There is also a top edge 64 that can be grabbed to begin initial tilting of the bin 60.

FIG. 7 shows another configuration for a bin 70 that can be used with the same housing 22 of the refrigerator 10 described above. In this figure, the bin 70 again has shorter walls 72 extending upward from the bottom 27 of the storage area 26 of the bin 70. However, the bin 70 also includes a pair of handles 76 extending upward from the top edge 74 of the walls 72 of the bin 70. The handles 76 provide additional grips to aid in the tilting, removing, and transport of the bin 70. For example, the handles 76 provide efficient places to grasp the bin 70 for carrying the bin to a final destination. The handles 76 are molded or formed integrally with the walls 72 of the bin 70. However, it should be appreciated that, while a configuration of the handles 76 are shown in FIG. 7, other shapes and sizes of handles are considered to be part of the present invention. Similar to the bin 60 of FIG. 6, the bin 70 includes first and second guide tracks 28, 30 that are used with the guide points 32, 34 of the housing to aid in tilting and removing the bin 70 from the refrigerator 10. The bin 70 is tilted and removed in the same manner as described above.

As stated, the present invention includes multiple advantages over existing removable storage containers. For example, the present invention includes almost no moving parts that can break or become disfigured, which will prevent movement or removability of the bin 24. Furthermore, the present invention provides an apparatus and method that provides for easy and quick tilting and removability of the bin 24. There are no buttons that need to be pushed to allow movement, and no gears or other moving mechanisms involved. Simply applying a force to rotate the bin 24 is all that is required. Furthermore, a lifting force is all that is required to remove the bin 24 from the housing 22. As such, when the storage assembly 20 is positioned on the interior of a door of a refrigerator 10, the quickness and ease of tilting and removing the bin 24 of the assembly 20 will allow the door to not be opened for an inconvenient amount of time. This will prevent too much cold air from escaping the refrigerator, which will lower the cooling costs of the refrigerator.

The foregoing description has been presented for purposes of illustration and description, and is not intended to be an exhaustive list or to limit the invention to precise forms disclosed. It is contemplated that other alternative processes obvious to those skilled in the art are considered to be included in the invention. The description is merely examples of embodiments. For example, the shape of the bin, housing, guide tracks, notches, and other components of the storage assembly 20 may be varied according to the size of the storage assembly 20 and location of the storage assembly 20. Furthermore, as stated, the opaqueness of the materials used may also be varied. In addition, as noted above, the housing 22 may be integrally formed with the liner of the refrigerator 10 such that a separate housing 22 is not required in the refrigerator 10. Also, the present invention contemplates that a refrigerator 10 include multiple or a plurality of removable bins 24, such that the bins 24 may be transferrable between a plurality of housings as preferred by the consumer. It is understood that any other modifications, substitutions, and/or additions may be made, which are within the intended spirit and scope of the invention. From the foregoing, it can be seen that the present invention accomplishes at least all of the stated objectives.

What is claimed is:

1. A refrigerator, comprising:

a cabinet;

at least one door for providing access to within the cabinet;

a storage assembly positioned within the cabinet and comprising a housing and a removable bin;

wherein the bin comprises a storage area and a first guide track on the outside of the storage area configured to define movement of the bin between a closed position and an open position, the first guide track comprising a first arched section and a second section, the first arched section comprising a first end and a second end, the second section comprising a third end and a fourth end, the third end intersecting the first arched section at a third location spaced from both the first end and the second end, the fourth end being located at an end of the bin:

wherein the bin is removable along the first guide track when in a third position along the first guide track at a distance from and between the open position and the closed position;

wherein the housing comprises a guide point configured to direct the movement of the bin about the guide track and a pivot point;

wherein the guide point is at the first end in the closed position, and wherein the guide point is at the second end in the open position; and wherein the first track is configured to prevent removal when in the closed position and prevent removal when in the open position.

2. The refrigerator of claim 1 wherein the first guide track of the bin comprises a lock configured to hold the guide point in the closed position.

3. The refrigerator of claim 1 wherein housing further comprises a lock positioned rearwardly of the pivot point and configured to hold the bin in the closed position.

4. The refrigerator of claim 1 wherein the bin is rotatable about the pivot point.

5. The refrigerator of claim 1 wherein the bin further comprises a second guide track on an opposite outer side of the storage area, the second guide track mirroring the first guide track.

6. The refrigerator of claim 5 wherein the housing further comprises a second guide point and pivot point, the second guide point configured to move along and guide the second guide track.

7. The refrigerator of claim 1 wherein the first guide track comprises a first arched section configured to tilt the bin about the pivot point.

8. The refrigerator of claim 7 wherein the first guide track further comprises a second section extending along the height of the bin and configured to guide the removal of the bin from the housing.

9. The refrigerator of claim 1 wherein the pivot point is configured to support the bin within the housing in the cabinet.

10. The refrigerator of claim 9 wherein the bin further comprises a notch configured to house the pivot point.

11. The refrigerator of claim 10 wherein the notch is positioned at the bin in a position in front of the center of gravity of the bin.

12. A storage assembly, comprising:

a housing comprising a first guide point; and a removable bin comprising a storage area and a guide track positioned on the outside of a wall of the storage area, the guide track comprising a first arched section and a second section, the first arched section comprising a first end and a second end, the second section comprising a third end and a fourth end, the third end intersecting the first arched section at a third location spaced from both the first end and the second end, the fourth end being located at an end of the bin;

wherein the first guide point is configured to reside within the guide track and the bin is configured to move relative to the first guide point along the track to tilt the bin between a closed position and an open position; and wherein the guide track is configured to allow selective removal of the bin from the housing when in a third position along the track at a distance from and between the open position and the closed position.

13. The assembly of claim 12 wherein the housing further comprises a first pivot point configured to support the bin at a notch.

14. The assembly of claim 13 wherein the housing further comprises a second pivot point positioned on an opposite side of the housing and configured to provide additional support for the bin.

15. The assembly of claim 14 wherein the bin further comprises a lock in the guide track configured to hold the bin in a closed position.

16. The assembly of claim 12 further comprising a second guide track and a second guide point positioned on an opposite side of the storage bin and generally mirroring the first guide point and guide track.

17. A method of tilting and removing a storage bin from a housing, comprising:

providing a storage bin assembly comprising a housing having a guide point and a pivot point, and a bin having a storage area and a track positioned on the outside of a wall of the storage area, the track comprising a first arched section and a second section, the first arched section comprising a first end and a second end, the second section comprising a third end and a fourth end, the third end intersecting the first arched section at a third location spaced from both the first end and the second end, the fourth end being located at an end of the bin;

tilting the bin by pulling the top of the bin to move a first section of the track relative to the guide point from a closed position to an open position; and removing the bin at a third position along the track between the open position and the closed position by moving a second section of the track relative to the guide point in a generally upward manner.

18. The method of claim 17 further comprising holding the bin in the closed position by using a locking feature on the bin.

* * * * *